US006073926A

United States Patent [19]

Kaneda et al.

[11] Patent Number: 6,073,926

[45] Date of Patent: Jun. 13, 2000

[54] SHEET DISCHARGE DEVICE

[75] Inventors: Hiroshi Kaneda, Amimachi; Tsunemitsu Kazama, Yamanashi-ken, both of Japan

[73] Assignees: Nisca Kabushiki Kaisha, Yamanashi-ken; Riso Kagaku Corporation, Tokyo, both of Japan

[21] Appl. No.: 09/036,064

[22] Filed: Mar. 6, 1998

[30] Foreign Application Priority Data

Mar. 12, 1997 [JP] Japan ..... 9-078859

[51] Int. Cl.[7] ..... B65H 31/36

[52] U.S. Cl. ..... 271/221; 271/224

[58] Field of Search ..... 271/224, 220, 271/222, 221, 223, 182

[56] References Cited

U.S. PATENT DOCUMENTS

| | | | |
|---|---|---|---|
| 4,380,332 | 4/1983 | Davis | 271/224 |
| 5,562,281 | 10/1996 | Honda et al. | 271/220 |
| 5,797,597 | 8/1998 | Kakuta et al. | 271/96 |
| 5,890,713 | 4/1999 | Hofmann et al. | 271/224 |

FOREIGN PATENT DOCUMENTS

| | | | |
|---|---|---|---|
| 524503 | 5/1956 | Canada | 271/221 |
| 0134465 | 6/1988 | Japan | 271/224 |
| 918938 | 2/1963 | United Kingdom | 271/224 |

*Primary Examiner*—H. Grant Skaggs

*Attorney, Agent, or Firm*—Pitney, Hardin, Kipp and Szuch LLP

[57] ABSTRACT

There is disclosed a sheet distribution device in which by making various the modulus of elasticity of a stopper member and a sheet matching member, a stopper function at the time of discharging a sheet and a matching function at the time of matching the sheet are sufficiently fulfilled, respectively. The sheet discharge device is provided with a sheet position regulating member which abuts on a discharge tip end of a sheet 2 with an image formed thereon discharged from an image forming device 1 onto a distribution bin 4 to regulate a position of the sheet 2. The position regulating member is constituted of a stopper member 45 and a sheet matching member 40 which differ in modulus of elasticity from each other. At the time of discharging the sheet and at the time of matching the sheet, the stopper member 45 is moved relative to the sheet matching member 40 to advance or retreat in a sheet conveying direction.

2 Claims, 12 Drawing Sheets

SHEET DISCHARGE DEVICE

BACKGROUND OF THE INVENTION

1. Field of the Invention

The present invention relates to a sheet discharge device, particularly to a sheet discharge device provided with a sheet position regulating member which abuts on a discharge tip end of a sheet with an image formed thereon to be discharged from a printer, a copying machine or another image forming device onto a tray to regulate a position of the sheet.

2. Description of the Related Art

A known sheet distribution device usually called "sorter" is provided with plural distribution bins arranged for successively receiving a sheet with an image formed thereon (hereinafter, referred to as the printed sheet) discharged from a printer, a copying machine or another image forming device and accumulating plural sheets, a first sheet conveying portion for conveying the printed sheets from a sheet discharge portion of the image forming device to a vicinity of a top tray of the distribution bin, a second sheet conveying portion for receiving the printed sheet from the first sheet conveying portion to convey the sheet to a vicinity of a lowermost distribution bin, and an indexer vertically movably provided along a sheet receiving end of the distribution bin for receiving the printed sheet from the second sheet conveying portion to eject/distribute the sheet to each distribution bin. When the sheets accumulated on each distribution bin reach a predetermined number or more, a bunch of sheets on the distribution bin are bundled and stapled together by using a stapler which can move along sheet receiving openings of plural distribution bins.

The sheet distribution device needs to have a distribution rate in accordance with an image forming rate of the image forming device. However, in a stencil printer or another image forming device which has a very high forming rate, the rate at which the sheet is ejected from the indexer to each distribution bin also becomes relatively high. To soften a shock provided is a stopper member for elastically contacting the discharge tip end of the sheet to regulate the position of the sheet. On the other hand, for the stapling or another post-processing of the printed sheets accumulated on the distribution bin, every sheet or every plural sheets need to be matched with a predetermined sheet reference face in such a manner that sheet end faces are aligned. For this purpose, a sheet matching member is necessary.

In the conventional sheet distribution device as described above, a sheet matching member for matching the sheets in a sheet conveying direction is partially provided with an elastic member to also serve as the stopper member when the sheets are ejected. Since the matching performance is different from the stopper performance, in the conventional device, the stopper member insufficiently regulates the sheet position if the device is designed on the basis of sheet matching. Also, if the device is designed on the basis of the stopper performance, the sheet matching member insufficiently fulfills its matching function. Therefore, sheets are disadvantageously aligned improperly.

SUMMARY OF THE INVENTION

Wherefore, an object of the invention is to provide a sheet discharge device in which by making variable an elasticity modulus of a stopper member and a matching member, a stopper function for discharging sheets and a matching function for matching the sheets can be sufficiently fulfilled, respectively.

To attain this and other objects, the invention provides a sheet discharge device which is provided with a sheet position regulating member for abutting on a discharge tip end of a sheet with an image formed thereon discharged from an image forming device onto a tray to regulate a position of the sheet. An elasticity modulus of the position regulating member is made variable.

Also, in the sheet discharge device according to the invention, the elasticity modulus of the position regulating member is made variable when the sheet is discharged onto the tray and when the sheet discharged onto the tray is matched.

Further, in the sheet discharge device of the invention, the position regulating member is constituted of two elastic members which differ in modulus of elasticity from each other. The elastic members can relatively advance or retreat in a sheet conveying direction when the sheet is discharged and when the sheet is matched.

BRIEF DESCRIPTION OF THE DRAWINGS

FIGS. 13A to 13H are explanatory views showing a sheet matching process.

DETAILED DESCRIPTION OF THE PREFERRED EMBODIMENTS

Figure 1:
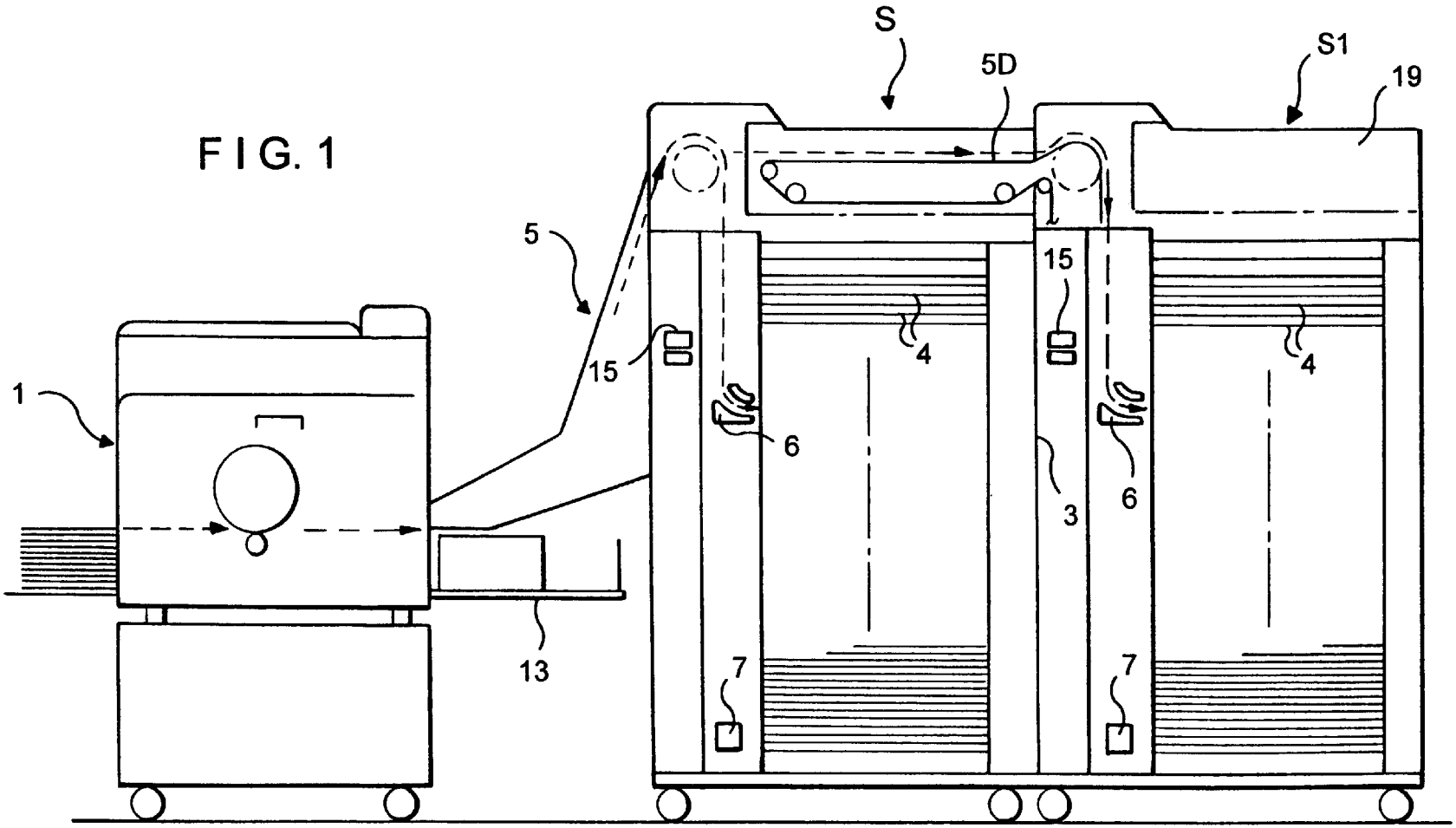
FIG. 1 is a diagrammatic side view showing a sheet distribution device as an embodiment of a sheet discharge device according to the invention which is connected to an image forming device.
Figure 2:
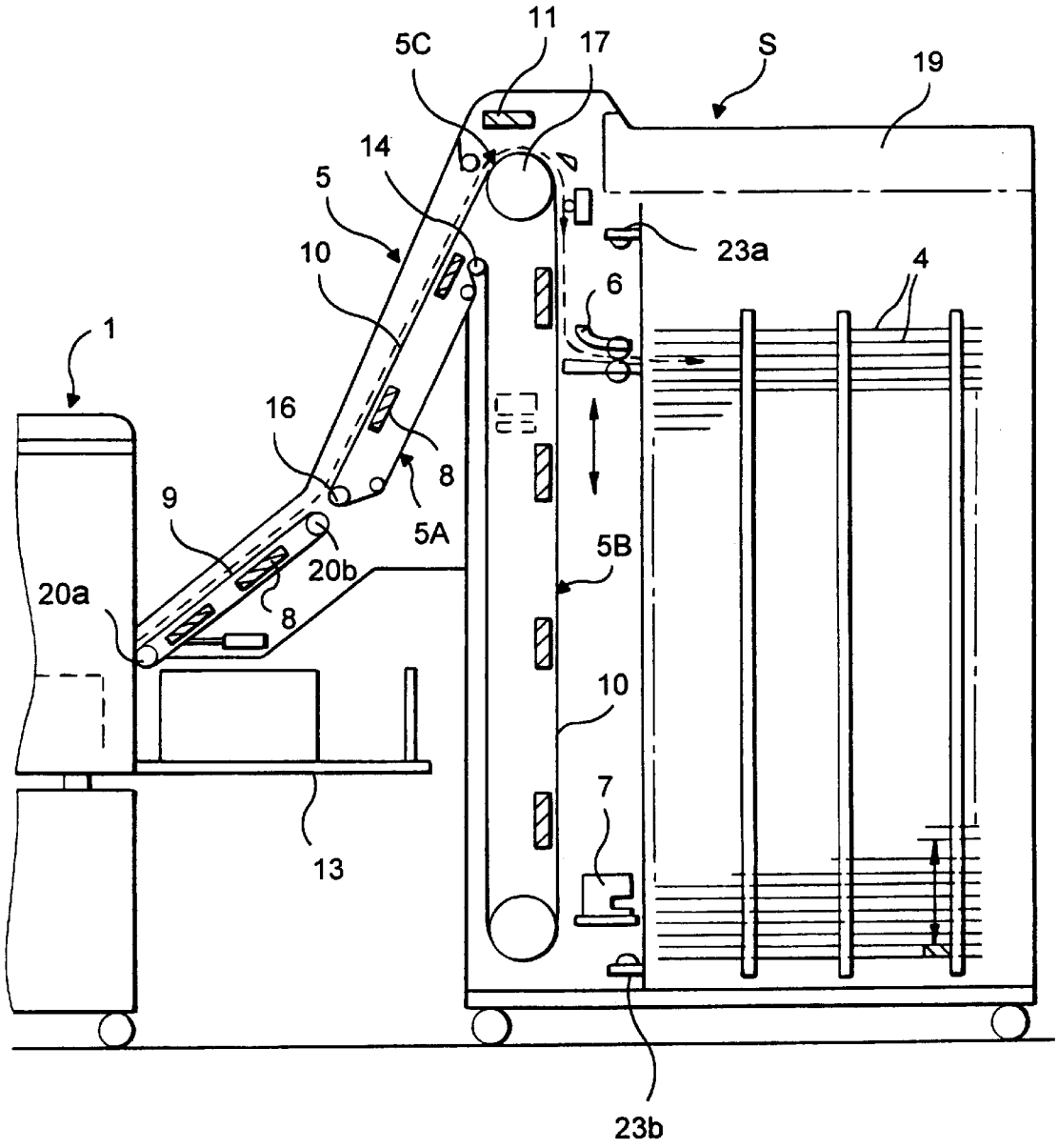
FIG. 2 is a diagrammatic side view showing an inner structure of the sheet distribution device of FIG. 1 in a perspective manner.

Embodiments of a sheet discharge device according to the invention will be described with reference to the accompanying drawings. FIGS. 1 and 2 show an entire constitution of the sheet distribution device: FIG. 1 is a diagrammatic side view showing a constitution in which the sheet distribution device is connected to an image forming device; and FIG. 2 is a diagrammatic side view showing an inner structure of the sheet distribution device of FIG. 1 in a perspective manner.

A sheet distribution device S is provided with plural distribution bins 4 constituted of, for example, fifty trays arranged vertically with predetermined intervals kept thereamong in a fixed position in a frame 3 for successively receiving an image formed sheet or printed sheet 2 (FIG. 3) from a printer or another image forming device 1 to accumulate a predetermined number of sheets; a conveying means 5 for conveying the printed sheet 2 from the image forming device 1 to the distribution bin 4; an indexer 6 vertically movably arranged along sheet receiving ends of plural distribution bins 4 for changing a direction of the sheet 2 conveyed by the conveying means 5 with a curved top-face guide portion before supplying and distributing the sheet 2 to each distribution bin 4; and a stapler 7 movable vertically or horizontally along the sheet receiving end of the distribution bin 4 for stapling or bundling the sheets. Also, on the side of the stapler 7 provided is a sheet bunch push-back member (not shown). Thereby, after a bunch of sheets pushed by a sheet bunch pushing member 50 described later onto the distribution bin 4 are stapled by the stapler 7, the stapled bunch of sheets are pushed back again to the distribution bin 4.

When the image forming device 1 is a printer, especially, a stencil printer, a large number of sheets can be printed in a short time. The sheet 2 with a wet ink loaded thereon is discharged at a high speed. In the conveying means 5 for conveying the sheet 2 from the image forming device 1 to the indexer 6, during conveying, a rear face of the sheet 2 is drawn and held to be kept away from a surface of another sheet.

As shown in FIG. 2, the conveying means 5 is provided with a first conveying portion 5A for conveying the sheet 2 from a sheet discharge portion of the image forming device 1 obliquely upward to a body upper portion, and a second conveying portion 5B for conveying the sheet 2 from the upper portion downward to the indexer 6. An upper end of the second conveying portion 5B receives the sheet 2 from the first conveying portion 5A, and forms a curved portion 5C for curving its conveying direction at an acute angle.

Figure 3:
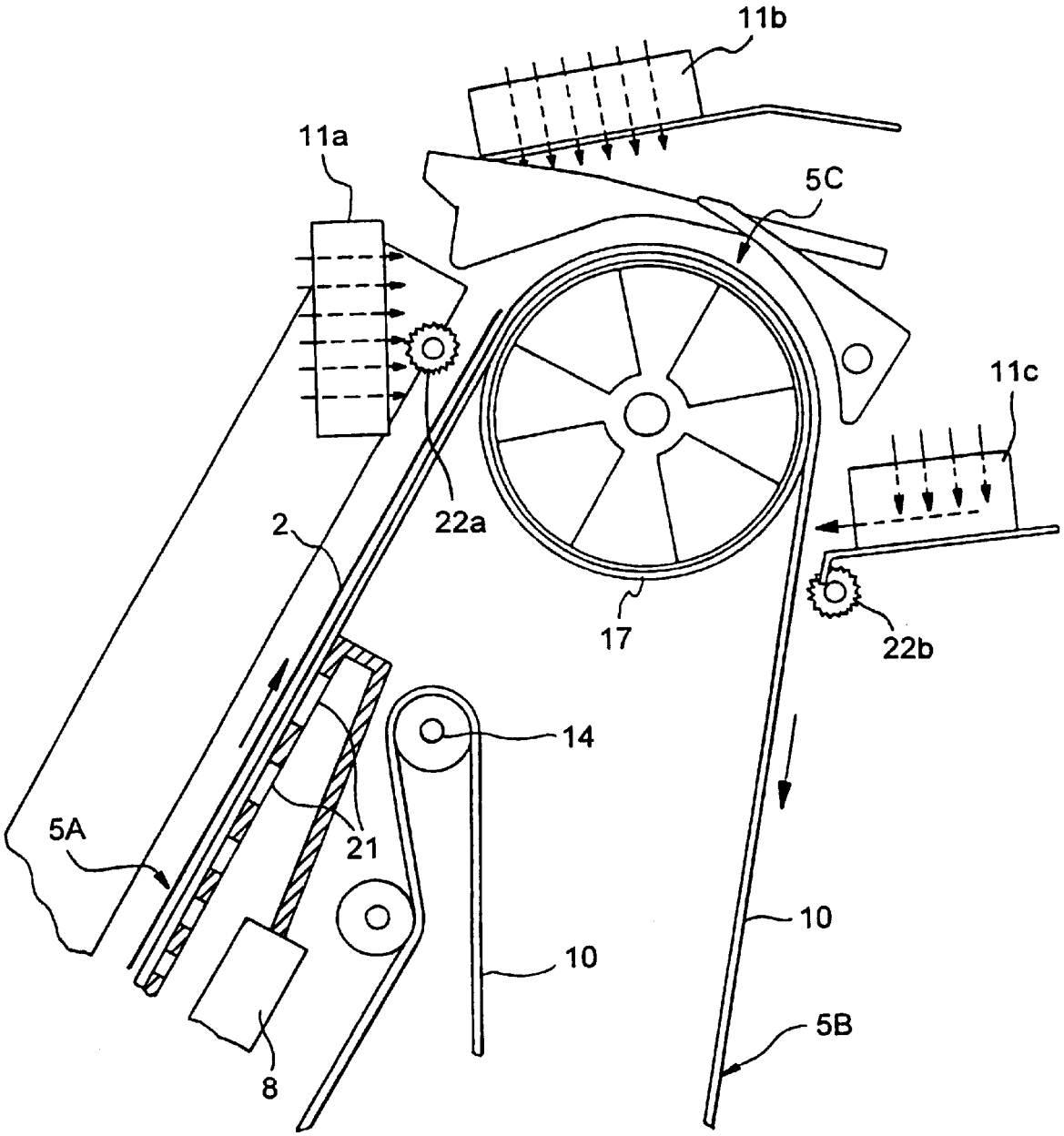
FIG. 3 is a side view showing a vicinity of a curved portion of a conveying means.
Figure 4:
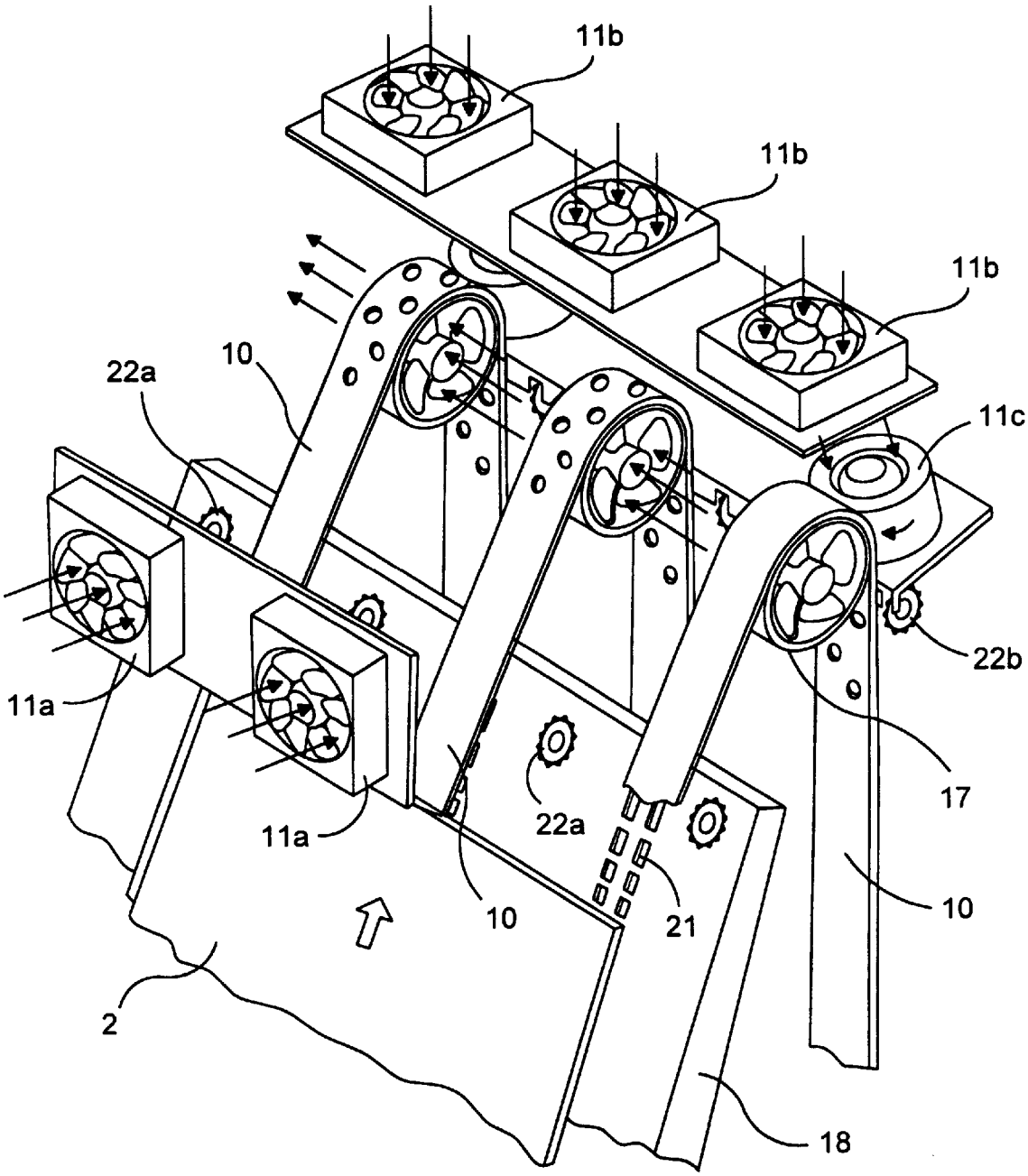
FIG. 4 is an exploded perspective view showing the vicinity of the curved portion of the conveying means.

The first conveying portion 5A is divided into an upstream conveying portion and a downstream conveying portion. In the upstream conveying portion, a perforated conveying belt 9 is extended between belt pulleys 20*a* and 20*b* on both ends, and suction blowers 8 are disposed inside the conveying belt 9, so that the rear face of the sheet 2 is drawn and held during conveying. In the downstream conveying portion, a perforated conveying belt 10 is extended directly from a belt pulley 16 to a belt pulley 17 of the second conveying portion 5B, so that the sheet 2 can be smoothly delivered from the first conveying portion 5A to the second conveying portion 5B. Also, inside the downstream conveying portion of the first conveying portion 5A and the second conveying portion 5B, the suction blowers 8 are disposed in the same manner as aforementioned. On a rear side of the upper proximal end of the downstream conveying portion, there is provided a U-turn roller 14 for returning the perforated conveying belt 10 from the second conveying portion 5B to the first conveying portion 5A. In the curved portion 5C disposed is an air blower 11 which blows an air current to press the sheet 2 against a curved conveying face. Especially, for a vicinity structure of the curved portion 5C, as shown in FIGS. 3 and 4, around the upper end of the first conveying portion 5A, a box-like duct 18 is disposed on rear sides of the perforated conveying belts 10. Also, a pressure inside the duct 18 is reduced by the suction blowers 8. Further, the duct 18 has openings 21 which open toward the conveying belts 10 to draw and hold the sheet 2. The duct 18 is formed gradually shallow and the cross-sectional area thereof becomes smaller as the duct 18 is apart from the suction blowers 8. Also, the openings 21 are small near the suction blowers 8, and gradually become larger apart from the suction blowers 8. A suction retention force by means of the suction blowers 8 can be uniformed, while a sheet holding force is controlled.

Also, in the curved portion 5C on the upper end of the second conveying portion 5B, three large-diameter belt pulleys 17 are disposed, around which the perforated conveying belts 10 from the first conveying portion 5A are extended to be run and operated. Also, three air blowers 11*a*, 11*b* and 11*c* are directed toward a conveying face of the curved portion 5C to blow an air current thereto. By means of a pressure of the air current, the sheet 2 is bent or deformed along the curved configuration of the conveying face. By running the conveying belts 10, the sheet 2 is conveyed via the curved portion 5C downward to the indexer 6 by the second conveying portion 5B. Further, in the embodiment, in the vicinity of the air blowers 11*a* and 11*c* on the front and rear side of the curved portion 5C, a plurality of small press rollers 22*a* and 22*b* with saw teeth formed on peripheral faces are arranged in a transverse direction. In the curved portion 5C for curving the sheet 2 at an acute angle in the conveying direction, the press rollers 22*a* and 22*b* press and prevent the tip end of the sheet 2 from bouncing up. The press rollers 22*a* and 22*b* are effectively operative, especially, for conveying a thick sheet. Additionally, the press rollers 22*a* and 22*b* can be selectively operated in accordance with the types of sheets to be conveyed.

Also, as shown in FIG. 1, on the opposite side of the image forming device 1, the sheet distribution device S is cascade-connected to plural units of a slave machine S1 which has the same constitution as the body of the sheet distribution device S. The number of trays of the distribution bin 4 can thus be increased. When the slave machine S1 is connected, a third conveying portion 5D (junction conveying portion) for conveying the sheet 2 to the slave machine S1 is detachably attached to the upper portion. In the embodiment, as shown in FIGS. 1 and 2, a space 19 for storing the third conveying portion 5D is horizontally formed in the upper portion of the sheet distribution device S. The first conveying portion 5A of the slave machine S1 can be inserted and fixed in the space 19.

Also, the image forming device 1 is provided with a discharged sheet base 13 for accumulating the discharged sheets 2 when they are not sorted. Also, on an outer wall face of the sheet distribution device S attached is an outside electromotive stapler 15.

In the sheet distribution device S, as shown in FIG. 2, in the vicinity of the receiving end of the top tray of the distribution bin 4 and the receiving end of the lowermost tray of the distribution bin 4, a light emission sensor 23*a* and a light receiving sensor 23*b* are provided. The light emission sensor 23*a* detects that the sheet 2 fed from the indexer 6 is housed in the distribution bin 4, while the light receiving sensor 23*b* detects that a bunch of sheets are pushed out to a position in which the bunch can be stapled.

Figure 5:
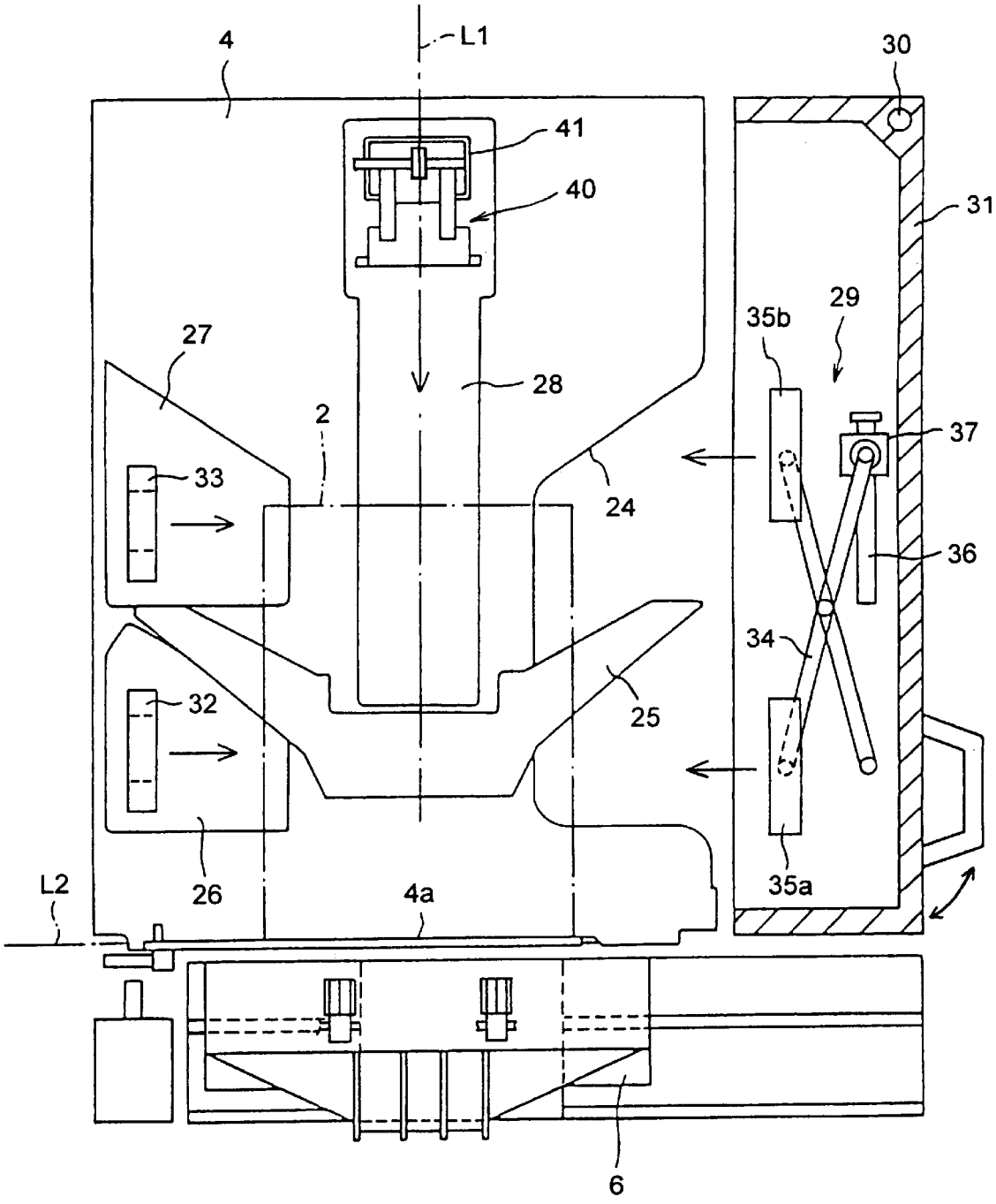
FIG. 5 is a plan view of a distribution bin in the sheet distribution device.

As shown in FIG. 5, the distribution bin 4 is a rectangular flat plate, and has in one side a large notched portion 24 via which the sheet 2 can be easily taken out. Also, on a top face of the distribution bin 4 disposed is a substantially V-shaped sheet support plate 25 which is protruded to a middle portion of the notched portion 24 to prevent the sheet 2 from hanging downward. In the distribution bin 4, two large openings 26 and 27 are formed on the opposite side of the notched portion 24, and further an elongated guide hole 28 is formed in a back to forth direction in the middle portion. Also, matching members are disposed in the notched portion 24, the openings 26, 27 and the guide hole 28, respectively, so that the sheet 2 is matched with two reference positions L1 and L2. A first matching member 29 provided in the notched portion 24 is housed inside a sheet taking-out door 31 which can be opened/closed about an axis 30. Together with a pair of second matching members 32 and 33 provided in the openings 26 and 27 on the opposite side, the first matching member 29 pushes opposite side edges of the sheet 2 to transversely move the sheet 2. The sheet 2 is thus matched with the middle reference position L1.

Especially, the first matching member 29 housed in the sheet taking-out door 31 is operated by a linkage 34. When the device is inoperative or when the sheet taking-out door 31 is opened/closed, the linkage 34 is contracted and housed in the door 31. On the other hand, when the sheet 2 is matched, the linkage 34 is expanded. Then, one side edge of the sheet 2 is pushed out by a pair of vertically long matching plates 35*a* and 35*b* which are mounted on tip ends of the linkage 34. The first matching member 29 is operated by a screw shaft 36 rotated by a motor (not shown) and a nut 37 which slides on the shaft 36. The operating portion is provided in the lower portion of the sheet taking-out door 31.

Figure 6:
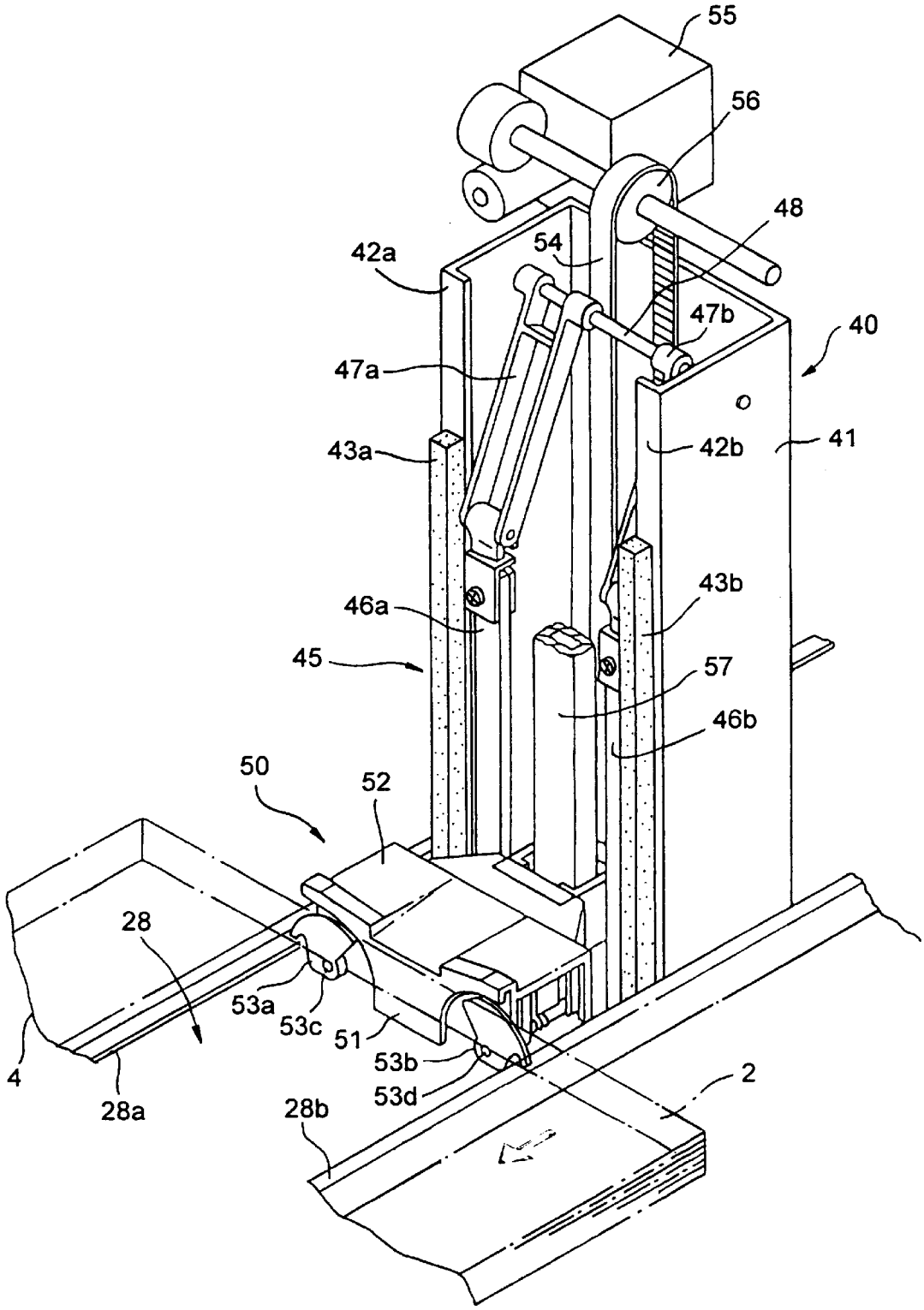
FIG. 6 is an enlarged perspective view showing a main portion of the invention.

A third matching member 40 is provided in the middle guide hole 28 for pushing the discharge tip end of the sheet 2 to match the sheet 2 with the reference position L2 along a vertical wall 4*a* which is built on the sheet receiving end of the distribution bin 4. The vertical wall 4*a* can be rotated about a support axis (not shown) which is attached to a lower end of the vertical wall 4*a*. When the sheets 2 are stapled by the stapler 7, the vertical wall 4*a* is rotated downward. Then, the bunch of sheets are pushed from the distribution bin 4 by a sheet bunch pushing member 50 described later. Also, when the vertical wall 4*a* is raised, the indexer 6 guides the sheet 2 from the vertical wall 4*a* into the distribution bin 4. As shown in FIGS. 5 and 6, the third matching member 40 is constituted of a guide rail 41 having a U-shaped cross section which is vertically passed through the distribution bin 4. As abutment faces relative to the printed sheet 2 to be matched, the guide rail 41 has on its edges of an opening flat vertical faces 42*a* and 42*b*. The vertical faces 42*a* and 42*b* are opposed to each other on the sheet receiving end of the distribution bin 4. Elastic members 43*a* and 43*b* formed of sponge or the like are placed along lengths of the vertical faces 42*a* and 42*b*. Additionally, the guide rail 41 can be moved by a drive mechanism (not shown) to advance or retreat in a horizontal direction along the guide hole 28. In some case the vertical faces 42*a* and 42*b* of the guide rail 41 are not provided with the elastic members 43*a* and 43*b* of sponge. In this case, the vertical faces 42*a* and 42*b* directly abut on the discharge tip end of the sheet 2.

Also in the embodiment, a string-like stopper member 45 is extended vertically in front of the third matching member 40. The stopper member 45 elastically thrusts at the discharge tip end of the printed sheet 2 ejected from the indexer 6 toward the distribution bin 4 to moderately stop the sheet 2. For this purpose, used are two bands 46*a* and 46*b* formed of rubber which provides a larger damper effect than sponge. As shown in FIG. 6, upper ends of the rubber bands 46*a* and 46*b* are rotatably attached to tip ends of levers 47*a* and 47*b*. When the sheet 2 thrusts at the rubber bands 46*a* and 46*b* with its discharge tip end, the rubber bands can be largely deflected. Rear ends of the levers 47*a* and 47*b* are fixed and supported onto a shaft 48 which is extended in the upper end of the guide rail 41. By rotating the shaft 48 with a drive means (not shown), the levers 47*a* and 47*b* are rotated back and forth. Therefore, as shown in FIG. 6, the rubber bands 46*a* and 46*b* can be positioned in front of the guide rail 41, or retreated back into the guide rail 41. Additionally, lower ends (not shown) of the rubber bands 46*a* and 46*b* are rotatably attached to levers which have the same constitutions as aforementioned.

In the embodiment, the sheet bunch pushing member 50 is disposed in front of the guide rail 41. After the indexer 6 finishes delivering and distributing all the sheets 2, to staple the sheets 2 as a post-processing, the bunch of sheets accumulated on the distribution bin 4 is pushed by the sheet bunch pushing member 50 onto an elevating/lowering passage of the indexer 6. As shown in FIG. 6, the sheet bunch pushing member 50 is provided with a body 52 having a pushing face 51 formed on its front end and rotatable engaging members 53*a* and 53*b* provided on opposite sides of the pushing face 51 for engaging with opposite side edges 28*a* and 28*b* of the guide hole 28. When the engaging members 53*a* and 53*b* are rotated inwardly relative to each other about support axes 53*c* and 53*d*, respectively, the engaging members 53*a* and 53*b* are disengaged from the side edges 28*a* and 28*b* of the guide hole 28. The body 52 can thus be moved vertically in the guide hole 28. The sheet bunch pushing member 50 is elevated or lowered by a belt 54 which is extended vertically in the guide rail 41. A rear end of the body 52 is fixed to the belt 54. Additionally, in FIG. 6, numeral 55 denotes a motor for operating the belt 54, 56 denotes a pulley on which the belt 54 is wound in the vicinity of the top distribution bin 4, and 57 denotes a guide rod for holding linearity when the sheet bunch pushing member 50 is elevated or lowered. Upper and lower ends of the guide rod 57 are fixed to the guide rail 41. To inhibit the accumulated sheets 2 from hanging downward into the guide hole 28, the opposite side edges 28*a* and 28*b* of the guide hole 28 are raised obliquely along peripheral edges to form faces higher than the top face of the distribution bin 4. Also, the sheet bunch pushing member 50 has a stand-by position which is higher than the top tray of the distribution bin 4. As described later, even when the guide rail 41 is moved horizontally along the guide hole 28 for delivering and matching the sheet 2 in the distribution bin 4, the sheet bunch pushing member 50 fails to abut on the sheets 2 accumulated on the distribution bin 4.

Figure 7A:
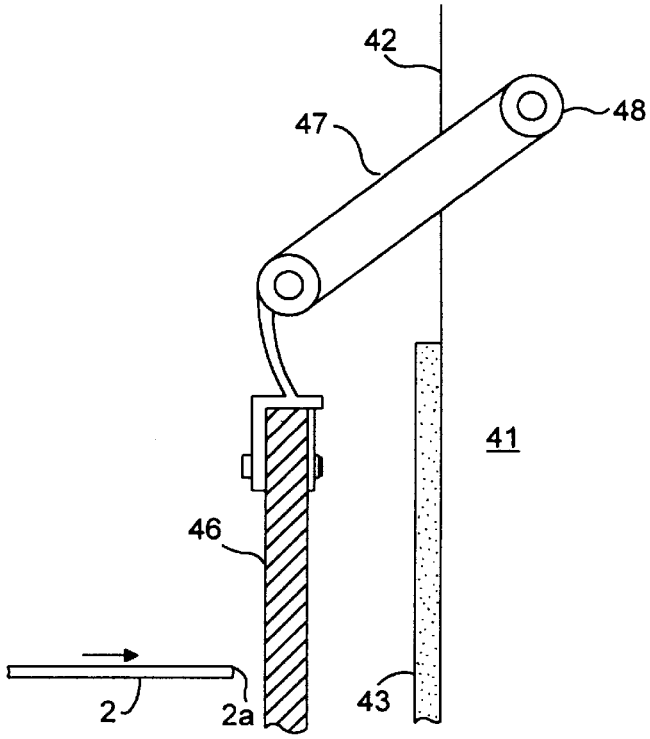
FIGS. 7A and 7B are explanatory views showing an action of a stopper member.
Figure 7B:
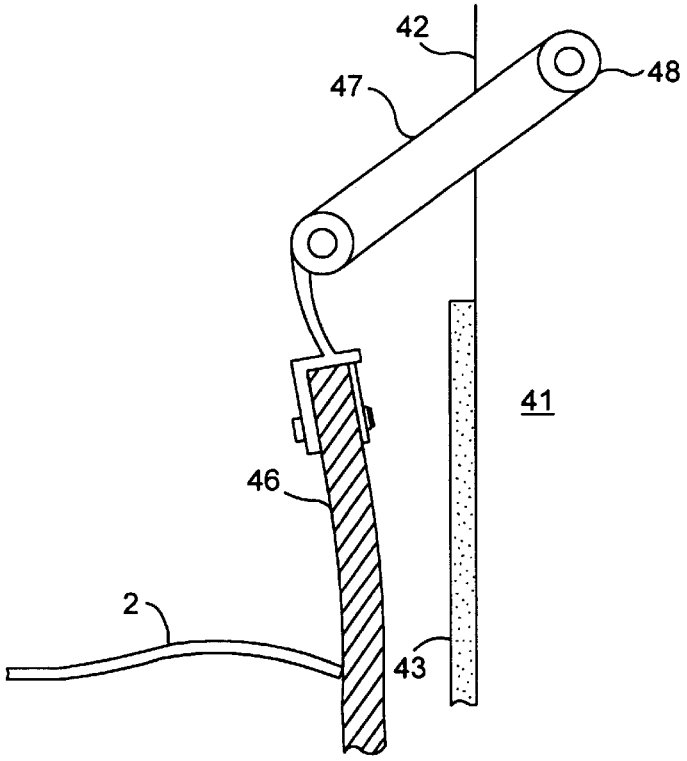

Operation of the stopper member 45 and the third matching member 40 positioned behind the stopper member 45 will be described with reference to FIGS. 7 and 8. First, when the printed sheet 2 is ejected from the indexer 6 to the distribution bin 4, as shown in FIG. 7A, the lever 47 is raised forward to position the rubber band 46 in front of the elastic member 43 of sponge placed on the vertical face 42 of the guide rail 41. In this condition, when the sheet 2 is ejected to the distribution bin 4, the sheet 2 thrusts at the rubber band 46 with a discharge tip end 2*a*. Then, as shown in FIG. 7B, the rubber band 46 is swung and largely deflected at its attachment portion to the lever 47. Therefore, its damper effect is performed, and a shock with the sheet 2 is reduced. The sheet 2 can be stopped moderately without bouncing back largely.

Figure 8A:
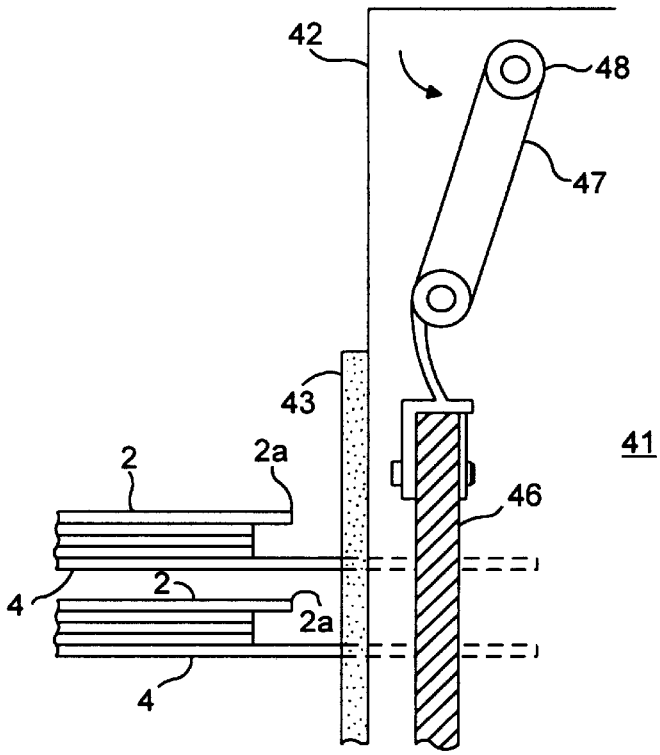
FIGS. 8A and 8B are explanatory views showing an action of a third matching member.
Figure 8B:
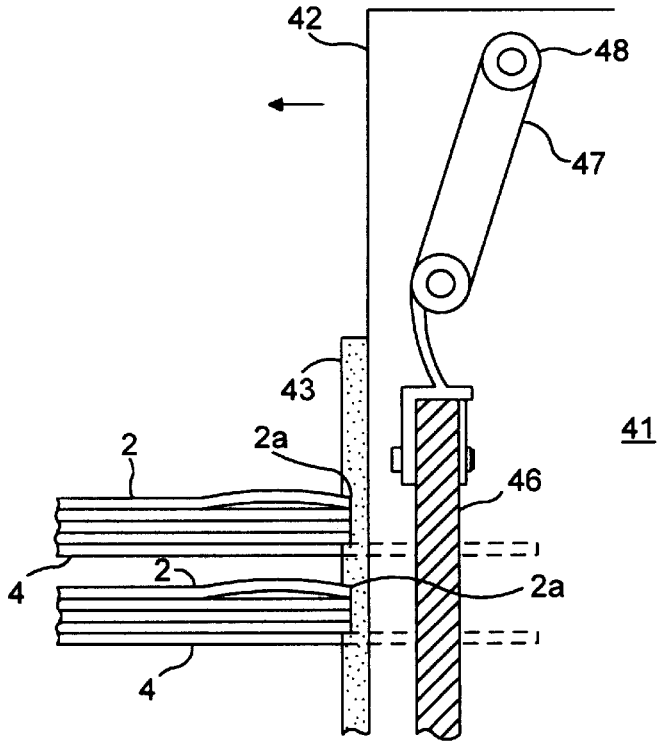

Subsequently, after the sheets 2 are ejected from the indexer 6 to all the distribution bins 4, first as shown in FIG. 8A, the lever 47 is rotated downward about the shaft 48 to retreat the rubber band 46 into the opening in the guide rail 41. Subsequently, as shown in FIG. 8B, the guide rail 41 is slid forward along the guide hole 28. While the discharge tip end 2*a* of the top sheet 2 on the distribution bin 4 is pushed by the elastic member 43 of sponge, the sheet 2 is moved to the matching position. The elastic member 43 of sponge provides a smaller damper effect, and is deflected less than the rubber band 46. Therefore, the elastic member 43 can push the discharge tip end 2*a* of the sheet 2 with a moderate elasticity and hardness.

Additionally, in the embodiment, at the time of discharging the sheets and at the time of matching the sheets, the stopper member 45 is moved back and forth along the guide hole 28 relative to the guide rail 41. Conversely, the guide rail 41 can be advanced or retreated relative to the stopper member 45.

Figure 9:
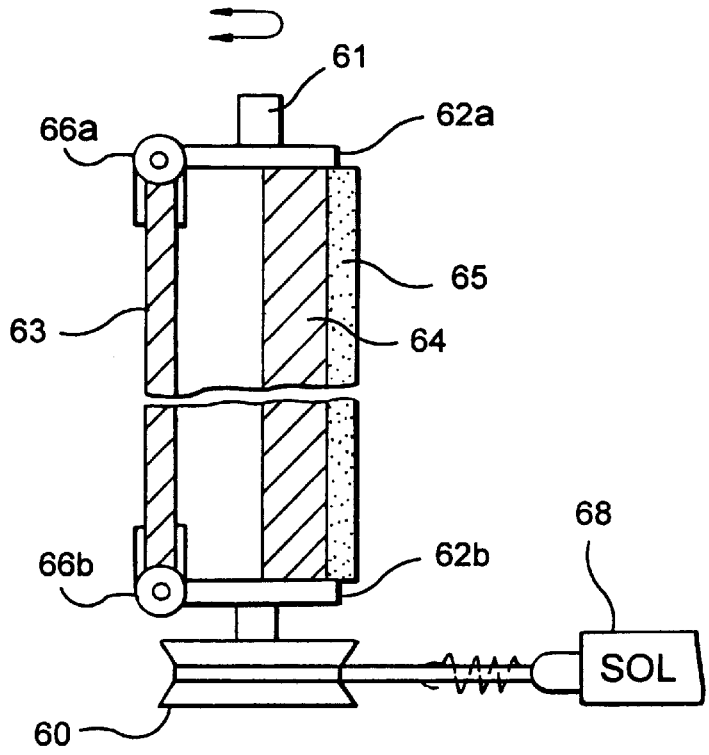
FIG. 9 is a diagrammatic sectional view showing another embodiment of a sheet position regulating member.
Figure 10:
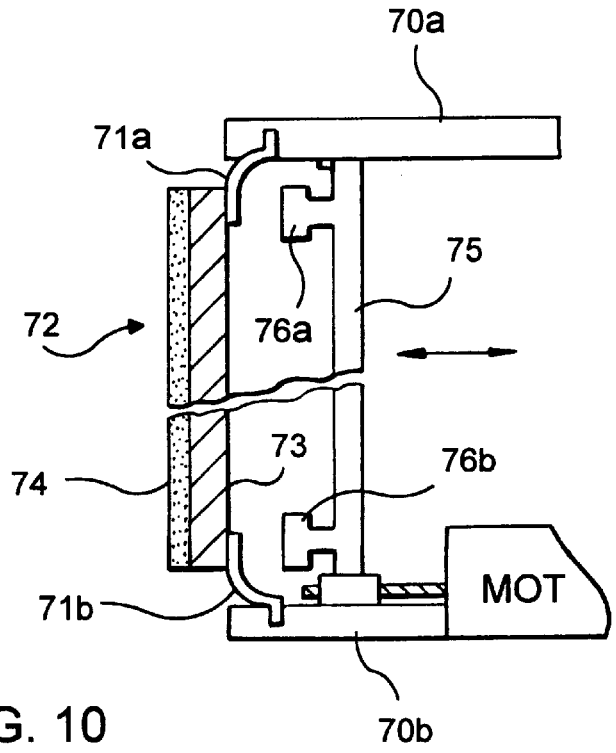
FIG. 10 is a diagrammatic sectional view showing further embodiment of the sheet position regulating member.

FIGS. 9 and 10 show another embodiments of the stopper member according to the embodiment. In the embodiment shown in FIG. 9, circular plates 62*a* and 62*b* are attached to upper and lower ends of a rotation shaft 61 which is coupled to a pulley 60. Between the circular plates 62*a* and 62*b* disposed is a rubber band 63 in front. Also, a sponge-like elastic body 65 integrally constituted with a rigid body 64 of an aluminum plate is disposed at the back of the rubber band 63. In the same manner as the embodiment described above, upper and lower ends of the rubber band 63 are attached to the circular plates 62*a* and 62*b*, and can be rotated about rotation axes 66*a* and 66*b*. Therefore, the rubber band 63 can be sufficiently deflected. Additionally, the rotation shaft 61 can be rotated forward and in reverse about its axial line by a drive means (not shown).

Therefore, by rotating the rotation shaft 61 by 180 degrees, the rubber band 63 or the sponge-like elastic body 65 can be opposed to the sheet 2. When the sheet 2 is ejected from the indexer 6 to the distribution bin 4, the rubber band 63 is opposed toward the sheet 2 to provide a large damper effect. On the other hand, when the sheet 2 on the distribution bin 4 is matched, the rubber band 63 is rotated to switch to the sponge-like elastic body 65. Then, by means of a solenoid 68, the entire stopper member is moved forward to push out the sheet 2.

In the embodiment shown in FIG. 10, instead of switching the rubber band and the sponge-like elastic body as aforementioned, an elastic force of one member is switched. Specifically, elastic members 71*a* and 71*b* of phosphor bronze or the like are slidably attached to upper and lower support plates 70*a* and 70*b*. A regulating member 72 is constituted of a rigid body 73 of an aluminum plate and a sponge-like elastic body 74 which is placed on a front face of the rigid body 73. Upper and lower ends of the regulating member 72 are supported from its rear side by the elastic members 71*a* and 71*b*. As required, the elastic members 71*a* and 71*b* are pushed from the rear side by a press member 75. Upper and lower ends of the press member 75 is slidably supported by the support plates 70*a* and 70*b*. Portions of the press member 75 which abut on the elastic members 71*a* and 71*b* have press faces 76*a* and 76*b* protruded and formed thereon.

Therefore, in the embodiment, when the sheet 2 is ejected from the indexer 6 to the distribution bin 4, the press member 75 is moved apart from the elastic members 71*a* and 71*b*, so that the regulating member 72 is supported only by the elastic members 71*a* and 71*b*. Then, a large damper effect of the regulating member 72 can be obtained. On the other hand, to operate the matching member, the rear faces of the elastic members 71*a* and 71*b* are pressed by the press faces 76*a* and 76*b*. By thus reducing the deflection of the regulating member 72, the regulating member 72 can be used as the matching member.

Figure 11:
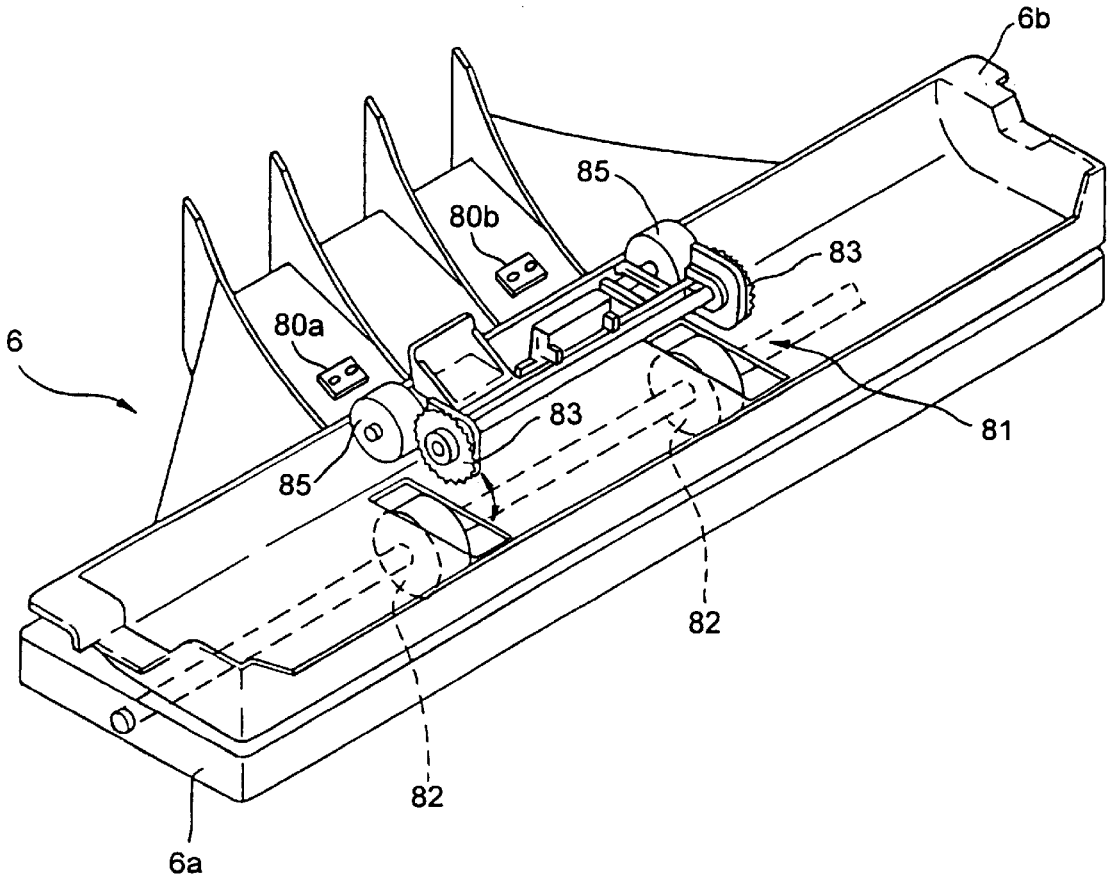
FIG. 11 is a perspective view showing an embodiment of a sheet inclination correcting device mounted on an indexer.
Figure 12:
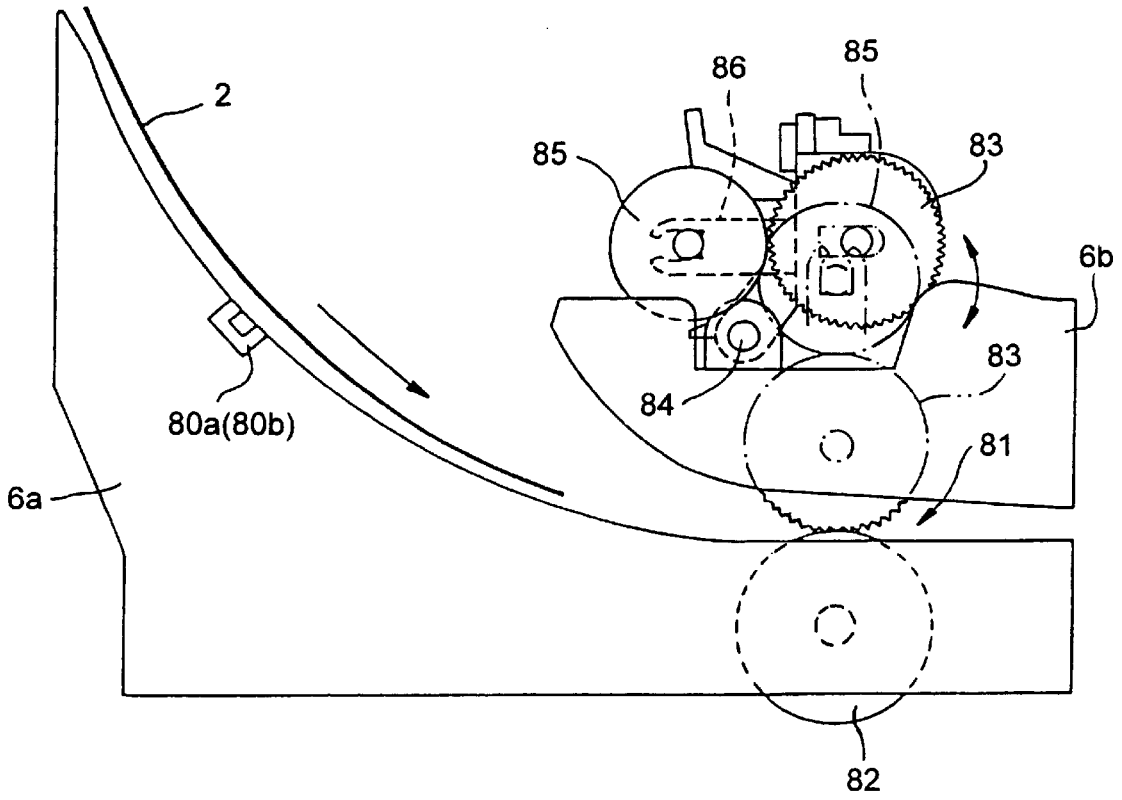
FIG. 12 is an enlarged sectional view of the inclination correcting device of FIG. 11.
Figure 13A:
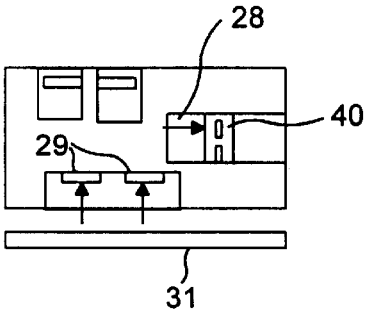
Figure 13B:
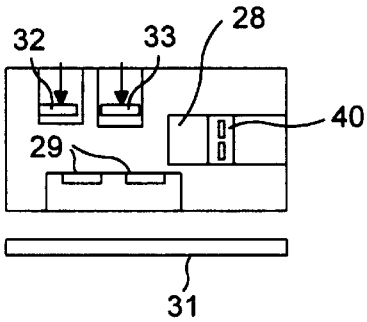
Figure 13D:
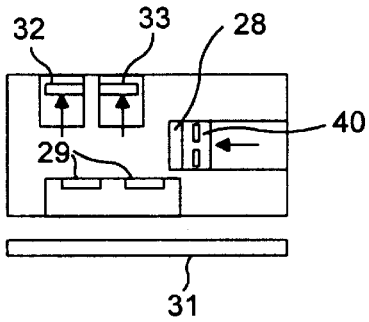
Figure 13D:
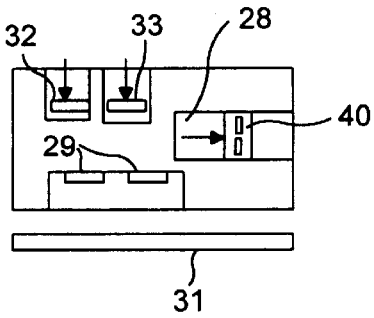
Figure 13E:
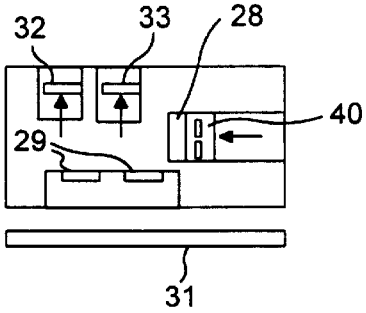
Figure 13F:
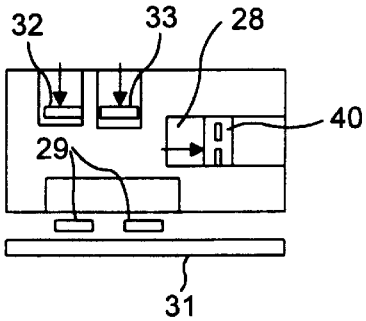
Figure 13G:
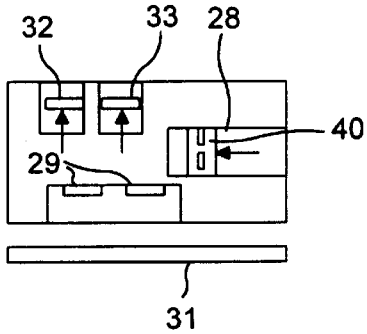
Figure 13H:
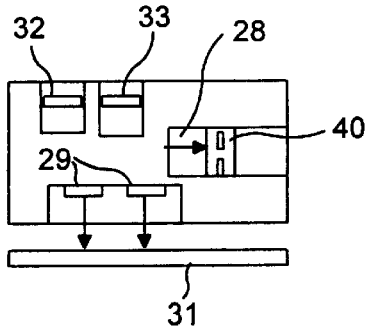

FIGS. 11 and 12 show sheet rear-end detecting sensors 80*a* and 80*b* and a correction roller 81 which are mounted on the indexer 6. A pair of the rear-end detecting sensors 80*a* and 80*b* are disposed in a right-to-left direction on a lower cover 6*a* of the indexer 6. Right and left rear ends of the sheet 2 which slides down along a slant face of the lower cover 6*a* are detected, respectively. From a difference in detection time, a bent degree of the sheet 2 is calculated. If the difference time exceeds a predetermined allowable time, a motor, a solenoid or another drive means (not shown) operates the correction roller 81 which is positioned in front of the drive means. The correction roller 81 is constituted of slide rollers 82 provided on the lower cover 6*a* of the indexer 6 and saw teeth-like rollers 83 which are provided above the slide rollers 82 and on an upper cover 6*b* of the indexer 6. The saw teeth-like rollers 83 can be rotated vertically about a rotation axis 84. Usually, the rollers 83 are positioned apart from the slide rollers 82. In this case, the sheet 2 naturally falls from the indexer 6 to the distribution bin 4. When the difference in time between the rear-end detecting sensors 80*a* and 80*b* exceeds the allowance, the saw teeth-like rollers 83 are rotated downward to abut on the slide rollers 82. The next sheet 2 is held between the rollers 82 and 83, and forced to be fed to the distribution bin 4. The sheet 2 is prevented as much as possible from being bent when accumulated on the distribution bin 4, so that the sheet matching can be smoothly performed. Additionally, clean rollers 85 having adhesive surfaces slidably abut on the saw teeth-like rollers 83 in such a manner that paper dust of the sheet 2 is removed from the saw teeth. Additionally, the clean rollers 85 are detachably attached to a support frame 86. In the embodiment, when the bent degree of the sheet 2 is detected, a guide may be displayed on an operation panel in such a manner that an operator manually operates the correction roller 81.

FIGS. 13A to 13H show a matching process of the sheet 2 on the distribution bin 4 in the sheet distribution device provided with the aforementioned constitution. The process from FIG. 13A to FIG. 13H will be described in order.

(A) First, the third matching member 40 which has been operated as the stopper member is retreated along the guide hole 28, while the first matching members 29 advance from the side of the sheet taking-out door 31 to push one side edge of the sheet.

(B) The first matching members 29 keep the advanced condition. The second matching members 32 and 33 advance to push the other side edge of the sheet. Then, the opposite sides of the sheet are matched.

(C) While the second matching members 32 and 33 retreat, the third matching member 40 advances to match front and rear sides of the sheet.

(D) While the third matching member 40 retreats, the second matching members 32 and 33 again advance to raise a precision in matching the opposite sides of the sheet.

(E) By repeating the operation in the above (C), the precision in matching the front and rear sides of the sheet is raised.

(F) By further repeating the operation in the above (D), the matching of the opposite sides of the sheet is finished.

(G) By further repeating the operation in the above (C), the matching of the front and rear sides of the sheet is finished.

(H) By retreating the third matching member, the matching of the right, left, front and rear sides is finished.

As aforementioned, according to the sheet distribution device of the invention, when the sheet is discharged from the image forming device to the tray and when the sheet discharged on the tray is matched, the modulus of elasticity of the sheet position regulating member which abuts on the sheet discharge tip end is properly switched. Therefore, the sheet stopping function and the sheet matching function can be sufficiently fulfilled.

What is claimed is:

1. A sheet discharge device having a sheet position regulating member disposed in the vicinity of a tray, said sheet position regulating member including a sheet stopping member and a sheet matching member, each having different elastic moduli wherein said sheet stopping member and said sheet matching member are selectively used so that when a sheet is discharged onto the tray the sheet is received stopped at its tip end on the tray by said sheet stopping member and after discharging and placing the sheet on the tray the sheet is pushed and repositioned to have a tip end of the sheet match to a predetermined position by said sheet matching member.

2. The sheet discharge device according to claim 1 wherein each of said sheet stopping member and said sheet matching member relatively advance and retreat when the sheet is discharged and when the sheet is repositioned.

* * * * *